US006012915A

United States Patent [19]

Mori et al.

[11] Patent Number: 6,012,915

[45] Date of Patent: Jan. 11, 2000

[54] METHOD OF COMBUSTING A WATER/ FOSSIL FUEL MIXED EMULSION AND COMBUSTION APPARATUS

[75] Inventors: Masahiro Mori; Toshiyasu Satoh, both of Hiratsuka, Japan

[73] Assignees: Zenshin Electric Power Engineering Company, Ltd., Hiratsuka; Tadashi Miyamoto, Tokyo, both of Japan

[21] Appl. No.: 09/203,379

[22] Filed: Dec. 2, 1998

[30] Foreign Application Priority Data

Dec. 3, 1997 [JP] Japan ..... 9-333036

[51] Int. Cl.[7] ..... F23J 7/00

[52] U.S. Cl. ..... 431/4; 431/8; 431/11; 431/278; 431/208

[58] Field of Search ..... 431/2, 4, 8, 11, 431/278, 175, 207, 208, 258, 354

[56] References Cited

U.S. PATENT DOCUMENTS

| | | | |
|---|---|---|---|
| 3,958,915 | 5/1976 | Noda et al. | 431/2 |
| 4,014,777 | 3/1977 | Brown | 431/354 |
| 4,144,015 | 3/1979 | Berthiaume | 431/4 |
| 5,249,957 | 10/1993 | Hirata | 431/4 |
| 5,370,525 | 12/1994 | Gordon | 431/258 |
| 5,511,969 | 4/1996 | Lopes et al. | 431/4 |

OTHER PUBLICATIONS

Uyehara, Dr. O.A. et al., *Fuel Oil Combustion With Water Only For Nox Suppression and Improved Energy Recovery*, 1995 Diesel Engine Emission Reduction Workshop, University of California—San Diego, Ca., (Jul. 25, 1995).

*Primary Examiner*—James C. Yeung
*Attorney, Agent, or Firm*—Birch, Stewart, Kolasch & Birch, LLP

[57] ABSTRACT

There is disclosed a method of combusting a water/fossil fuel mixed emulsion, which comprises elevating the temperature of a water/fossil fuel mixed emulsion, and vaporizing the emulsion, with a temperature-elevating and vaporizing apparatus 3, jetting the water/fossil fuel mixed gas thus formed by that elevation of the temperature and that vaporization from a burner 7, and bringing a Brown's gas flame of a Brown's gas combustion burner 5, in contact with the flow of the mixed gas, thereby combusting the water/fossil fuel mixed gas. There is also disclosed an apparatus for combusting a water/fossil fuel mixed emulsion. According to the combusting method and the combustion apparatus, it is possible to combust the water/fossil fuel mixed emulsion with good energy efficiency, and to obtain high calories resulting from the combustion.

11 Claims, 5 Drawing Sheets

METHOD OF COMBUSTING A WATER/FOSSIL FUEL MIXED EMULSION AND COMBUSTION APPARATUS

FIELD OF THE INVENTION

The present invention relates to a method of combusting a mixed emulsion of water with a fossil liquid fuel, such as petroleum, and to a combustion apparatus. More particularly, the present invention relates to a method of combusting a water/fossil fuel mixed emulsion that can combust the water/fossil fuel mixed emulsion with good energy efficiency, and that produces less exhaust gases that pollute the environment; and to a combustion apparatus.

BACKGROUND OF THE INVENTION

Conventionally, various ways of combusting a fossil liquid fuel in the form of a fuel emulsion formed by mixing it with water are proposed, in view of energy-saving or the like. Such a fuel emulsion includes, for example, an emulsion fuel or the like in which a special emulsifying agent is used that can make a petroleum-series fuel into a highly hydrophilic gel form by adding it to the fuel. Further, as the method of combusting this fuel emulsion, there is, for example, proposed a method wherein an emulsion fuel, in which water that is made cationic is used, is jetted into a hot cathode chamber heated to a high temperature at which water can be decomposed.

Since the fuel emulsion contains water, unlike a usual fossil fuel, it cannot be ignited in the air at normal temperatures by a burner or the like to be combusted completely, and particularly if the fuel emulsion has a high water content, it cannot be ignited in a usual manner. Hitherto, to utilize such a water-containing fuel emulsion as a fuel to be combusted completely, the temperature of the environment for the combustion has to be brought to a temperature as high as about 1,600° C. Accordingly, although the fuel emulsion itself is expected to be used in various applications, its complete combustion can only be realized in limited special environments. Further, it is difficult to keep such a high-temperature environment, for example, in generally operated furnaces, boilers, gas turbines, and the like, because the flow of the steam and the gas removes the heat, and in addition the energy efficiency and economy pose a great problem for its propagation and practical use.

In addition, in recent years, it is required to reduce the emission of $CO_2$ (carbon dioxide gas) on a global scale, and a fuel combustion system that can secure certain calories resulting from combustion with the emission of $CO_2$ lowered as much as possible is desired. Because of the admixture of water, the water/fossil fuel mixed emulsion can reduce the quantity of emission of $CO_2$ more than fossil fuels when combusted, and from this viewpoint as well there is need for a method and an apparatus for combusting a water/fossil fuel mixed emulsion efficiently and economically.

SUMMARY OF THE INVENTION

Therefore, an object of the present invention is to provide a method of combusting a water/fossil fuel mixed emulsion that can combust the water/fossil fuel mixed emulsion with good energy efficiency, to produce high calories resulting from the combustion.

Further, another object of the present invention is to provide a combustion apparatus that can combust a water/fossil fuel mixed emulsion efficiently economically.

Other and further objects, features, and advantages of the invention will appear more fully from the following description, taken in connection with the accompanying drawings.

DETAILED DESCRIPTION OF THE INVENTION

Figure 1:
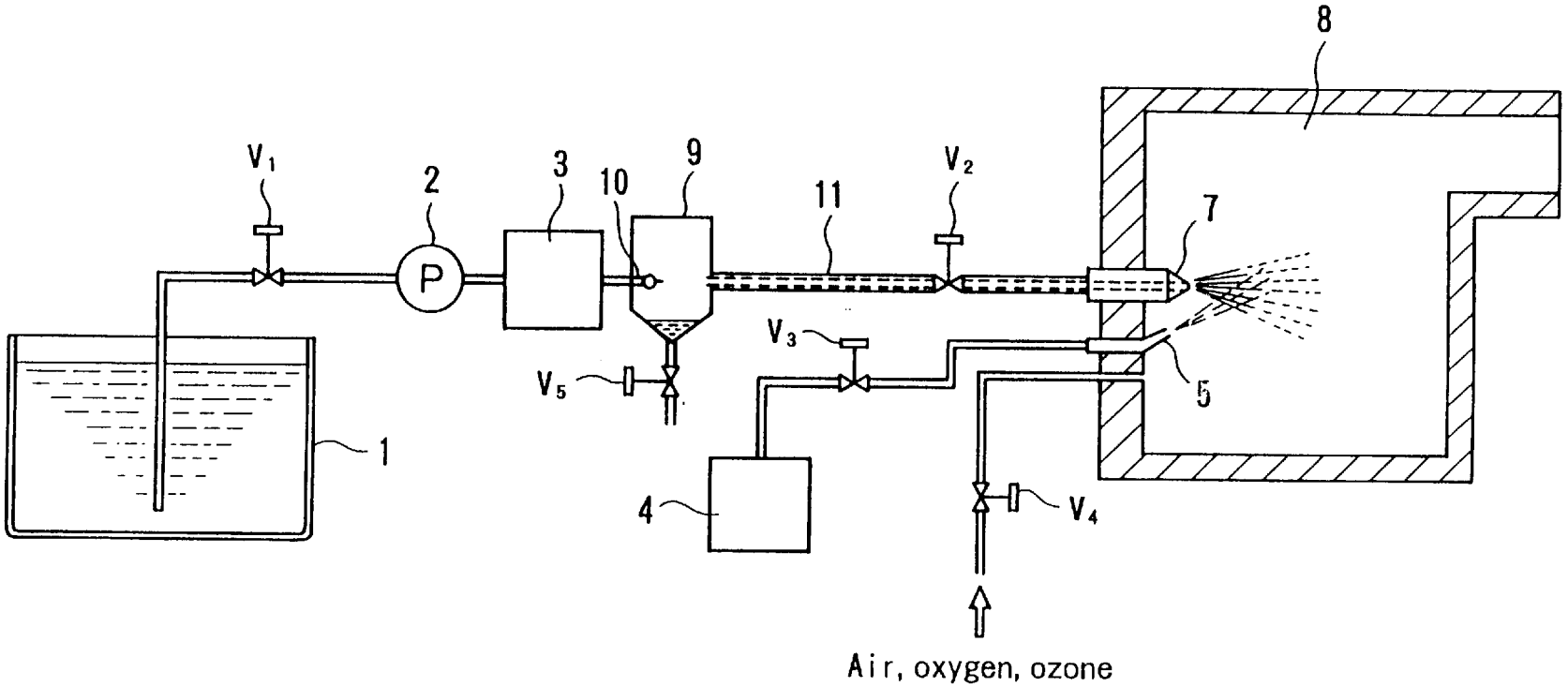
FIG. 1 is an illustrative view showing a constitution of the combustion apparatus of the present invention.

In view of the above objects, the inventors of the present invention, having intensively studied, have found that the above objects can be attained by bringing a flow of a gas, formed by elevating the temperature of a water/fossil mixed emulsion, and vaporizing (gasificating) it, in contact with a high-temperature flame resulting from the combustion of a Brown's gas, thereby reacting them to combust the gas, which finding has led to the present invention.

Namely, according to the present invention, there is provided:

(1) A method of combusting a water/fossil fuel mixed emulsion, comprising elevating the temperature of a water/fossil fuel mixed emulsion, vaporizing the water/fossil fuel mixed emulsion, and bringing a Brown's gas flame that results from the combustion of a Brown's gas, in contact with the flow of the water/fossil fuel mixed gas thus formed by that elevation of the temperature and that vaporization, thereby combusting the water/fossil fuel mixed gas;

(2) The method of combusting a water/fossil fuel mixed emulsion as stated in the above (1), wherein the proportion of the fossil fuel in the water/fossil fuel mixed emulsion is 10 to 30% by volume;

(3) The method of combusting a water/fossil fuel mixed emulsion as stated in the above (1) or (2), wherein the water/fossil fuel mixed emulsion is irradiated with microwaves, to elevate the temperature of the emulsion, thereby vaporizing the emulsion; and (4) An apparatus for combusting a water/fossil fuel mixed emulsion, comprising an apparatus for elevating the temperature of a water/fossil fuel mixed emulsion and vaporizing the water/fossil fuel mixed emulsion; a mixed gas burner for jetting the water/fossil fuel mixed gas that results from that elevation of the temperature and that vaporization; a Brown's gas combustion burner; and a combustion chamber provided with the mixed gas burner and the Brown's gas combustion burner; wherein, in the combustion chamber, the Brown's gas flame of the Brown's gas combustion burner can be in contact with the flow of the gas jetted from the mixed gas burner.

Hereinbelow, the present invention is described.

The water/fossil fuel mixed emulsion to be combusted in the present invention is a liquid fuel containing water and a fossil fuel liquid. As the fossil fuel liquid, for example, kerosene, light oil, heavy oil, and the like can be mentioned. The water is not particularly restricted, and it may be tap water, distilled water, and the like. The mixing proportion of the water and the fossil fuel liquid of the water/fossil fuel mixed emulsion that can be used in the present invention is not particularly restricted, but generally the proportion of the fossil fuel liquid in the emulsion (generally an oil-in-water type emulsion) is 5 to 85% by volume. In view of reducing the quantity of $CO_2$ emission at the time of the combustion, the proportion is preferably 10 to 30% by volume. For example, a water/fossil fuel mixed emulsion in which the proportion of water is increased using hydroxyl ion water (pH: 8.5 to 10), as previously proposed by the present inventors (Japanese patent application No. 9-308958), and the like can preferably be used. Further, if necessary, in addition to the water and the fossil fuel, a surfactant, an electric stone, and the like can be added to the water/fossil fuel mixed emulsion. In the meantime, when an electric stone, such as tourmaline, is added to the water/fossil fuel mixed emulsion, the particles thereof having a particle diameter of at most about several micrometers are finely dispersed. In this case, the emulsion can be considered to be in a colloidal state.

In the present invention, the temperature of the above water/fossil fuel mixed emulsion is elevated, to vaporize the emulsion, and the gas flow is jetted from a jet nozzle and is combusted. Although it varies depending on the manner of elevating the temperature and the manner of vaporization, preferably the temperature of the gas flow is 110° C. or more, more preferably 150° C. or more, and further preferably 180 to 300° C. The manner of elevating the temperature is not particularly restricted, but, in view of the combustion cost, preference is given to a method in which the emulsion is irradiated with microwaves (ultra-high frequencies), to elevate the temperature by the motion of the water molecules in the emulsion, over a method in which thermal energy is used. In order to cause the microwaves to be absorbed in the moisture in the emulsion, the emulsion has to be made into a high-pressure liquid, since the liquid state has to be retained even when the temperature thereof is elevated by heating. To that end, the water/fossil fuel mixed emulsion is satisfactorily pressurized, preferably to 3.0 to 4.5 Mpa, by a pump or the like before irradiated with microwaves, and then it is introduced into a microwave-irradiation apparatus. Therefore, the microwave-irradiation apparatus is made to have a structure resistant to pressure. By the irradiation with microwaves, the water and the fossil fuel are respectively vaporized, and they can be made into a mixed gas containing them homogeneously, which will lead to a good combustion state. The microwaves have preferably 2,450 to 3,000 MHz. The external input required for the microwave irradiation is generally 3% or less of the quantity of heat generated by the combustion of the water/fossil fuel mixed emulsion. The vaporization can be carried out, for example, by reducing the pressure, generally, to 0.05 to 0.15 MPa.

In the present invention, to elevate the temperature and vaporize the water/fossil fuel mixed emulsion, it is more preferable to use a liquid vaporization supply system that uses a carrier gas. Hereinbelow this liquid vaporization supply system is described.

In order to vaporize the water/fossil fuel mixed emulsion efficiently, a carrier gas is introduced, in addition to the emulsion, into a vaporizer provided in this liquid vaporization supply system, and the temperature thereof is elevated by a heater, such as an electric heater built in the vaporizer, to bring about conditions suitable for the vaporization. As the liquid vaporization supply system in the present invention, for example, a liquid vaporization supply system that uses a vaporization system described in U.S. Pat. No. 5,272,880, such as LV-1100M and AV-1100M (trade names, manufactured by Lintec Co.), can be used.

According to the above liquid vaporization supply system, by choosing conditions, such as the temperature elevation and the flow rate of the carrier gas, in conformity with the type of the water/fossil fuel mixed emulsion, the mixing proportion, and the like, the temperature elevation and the vaporization can be carried out without causing the separation of the water and the oil component (fossil fuel) in the emulsion, thereby allowing a quite good combustion state.

Further, in this liquid vaporization supply system that uses a carrier gas, the pressure under which the water/fossil fuel mixed emulsion is introduced into the vaporizer is not particularly restricted, but generally it is from ordinary pressure to 0.15 MPa. Further, in the vaporizer, by reducing the pressure of the emulsion that has been accelerated and pressurized by the carrier gas, the emulsion is vaporized. At that time, the accelerated emulsion is reduced in pressure, generally, to 0.05 MPa to ordinary pressure, and thereby vaporization is effected. In accordance with the degree of the reduction in pressure at the time of the vaporization, the gas pressure of the flow of the vaporized gas is determined, and therefore the length of the flame of the combustion of the gas flow can be controlled. Accordingly, in this liquid vaporization supply system, since, for example, the vaporizer and the like are not required to have a structure resistance to pressure, and the power of the pump or the like for introducing the water/fossil fuel mixed emulsion into the vaporizer can be small, preference is given to this over the above microwave irradiation, in that the vaporization can be carried out at a low cost using the simple apparatus.

Further, in the case of using the above liquid vaporization supply system, by using oxygen gas as a carrier gas, since the oxygen gas is also used as oxygen for the combustion of the fossil fuel in the combustion chamber, it is not required to take in air or the like separately for the combustion, and thus the apparatus can be made simple and the operating cost can be decreased.

A Brown's gas flame is brought in contact with the flow of the water/fossil fuel mixed gas, whose temperature has been elevated and which has been vaporized and jetted in the above manner.

The Brown's gas that is used in the present invention is itself a nonexplosive mixed gas that consists of hydrogen and oxygen mixed in a volume ratio of 2:1, and it is obtained by electrolysis of water; and it is known that the combustion thereof causes the molecular or atomic hydrogen and oxygen to produce heat of the reaction, thereby bringing about a quite high combustion temperature. In the present invention, the Brown's gas is combusted by using a torch nozzle and an igniter or the like for producing an ignition spark, to produce a highly reducing flame of about 2,300° C., and preferably the tip of the flame good in reactivity is brought in contact with the above mixed gas flow. The number of the Brown's gas combustion burners for bringing the Brown's gas flame in contact with the above mixed gas flow to combust the mixed gas may be 1 or 2 or more; preferably the Brown's gas combustion burners are used 2 or more, and more preferably 2 or 3 in number. Thus, the mixed gas is combusted at high temperatures. This is considered in such a way that the Brown's gas flame heats the mixed gas flow as well as interacts with active chemical species produced from the fossil fuel in the mixed gas, to combust the fossil fuel gas to generate a high temperature; this high temperature causes steam explosion of the moisture in the mixed gas, thereby combusting it as a hydrogen/oxygen gas flame (Brown's gas flame) at a high speed, and the flame propagation resulting therefrom leads to combustion throughout the mixed gas. The speed of the high-speed combustion by this steam explosion is, for example, about 6.75 times (linear velocity: 2.7 m/s) that of the combustion of propane.

In the above combustion mechanism, since the active chemical species react with the oxygen produced by the steam explosion, the quantity of oxygen to be supplied from outside at the time of the combustion is much smaller than that of usual combustion, and it is possible to make the system to be a combustion system that substantially does not use air. For example, if the water/fossil fuel mixed emulsion is an emulsion of a water:fossil fuel of 9:1 by volume, it is considered that the quantity of oxygen required from outside for the combustion is at most one-tenth of the conventional quantity.

Since the combustion method and the combustion apparatus of the present invention can obtain high calories resulting from the combustion, using a water/fossil fuel mixed emulsion reduced in the quantity of the fossil fuel to be used, they are economical and can reduce greatly the exhaust gas that will cause pollution, in comparison with when a fossil fuel or the like is combusted in the air.

Now, the combustion method and the combustion apparatus of the present invention are described in more detail with reference to the drawings.

FIG. 1 is an illustrative view showing the constitution of an embodiment of the apparatus of the present invention; in this example microwave irradiation is used to elevate the temperature of a water/fossil fuel mixed emulsion. In the figure, 1 indicates a storage tank of the water/fossil fuel mixed emulsion, 2 indicates a water/fossil fuel mixed emulsion supply pump, 3 indicates a microwave irradiation apparatus, 4 indicates a Brown's gas generating apparatus, 5 indicates a Brown's gas combustion burner, 7 indicates a mixed gas burner, 8 indicates a combustion chamber, 9 indicates a water/fossil fuel mixed emulsion vaporization chamber, 10 indicates a nozzle, 11 indicates a heat-resistant covering material, and each of $V_1$ to $V_5$ indicates a valve, respectively.

In the apparatus, the water/fossil fuel mixed emulsion, which is a high-pressure liquid fed into the microwave irradiation apparatus 3 through the valve $V_1$ by the supply pump 2 from the storage tank 1, is elevated in temperature with the irradiation of microwaves, and it is fed through the nozzle 10 into the vaporization chamber 9, where it is decreased in pressure and vaporized into a water/fossil fuel mixed gas. This vaporization chamber 9 also acts as a vapor-liquid separation chamber, and the liquid accumulated in the chamber can be discharged by opening the valve $V_5$.

The mixed gas, which is at about 150 to 200° C. as a result of the reduction in pressure, is passed through the valve $V_2$ and jetted from the mixed gas burner 7 of the combustion chamber 8. For transportation of this high-temperature gas, the piping is preferably covered with the heat-resistant covering material 11.

On the other hand, the Brown's gas combustion burner 5, near the mixed gas burner 7, jets out the Brown's gas, made in the Brown's gas generation apparatus 4, through the valve $V_3$ and ignites the Brown's gas by an igniter (not shown), to form a Brown's gas flame that is brought in contact with the gas flow from the mixed gas burner 7, thereby combusting the mixed gas flow.

The atmosphere in the combustion chamber 8 is the normal ambient atmosphere, but one or more of air, oxygen, or ozone can be introduced from outside through the valve $V_4$, to control the composition of the gas in the combustion chamber 8 (for example, to make the atmosphere in excess of oxygen or the like). In the present invention, when the water/fossil fuel mixed emulsion is combusted, it is not required to elevate the temperature of the combustion chamber 8 as a whole, and the contact of the Brown's gas flame can cause the gas produced from the water/fossil fuel mixed emulsion to be combusted completely.

Figure 2:
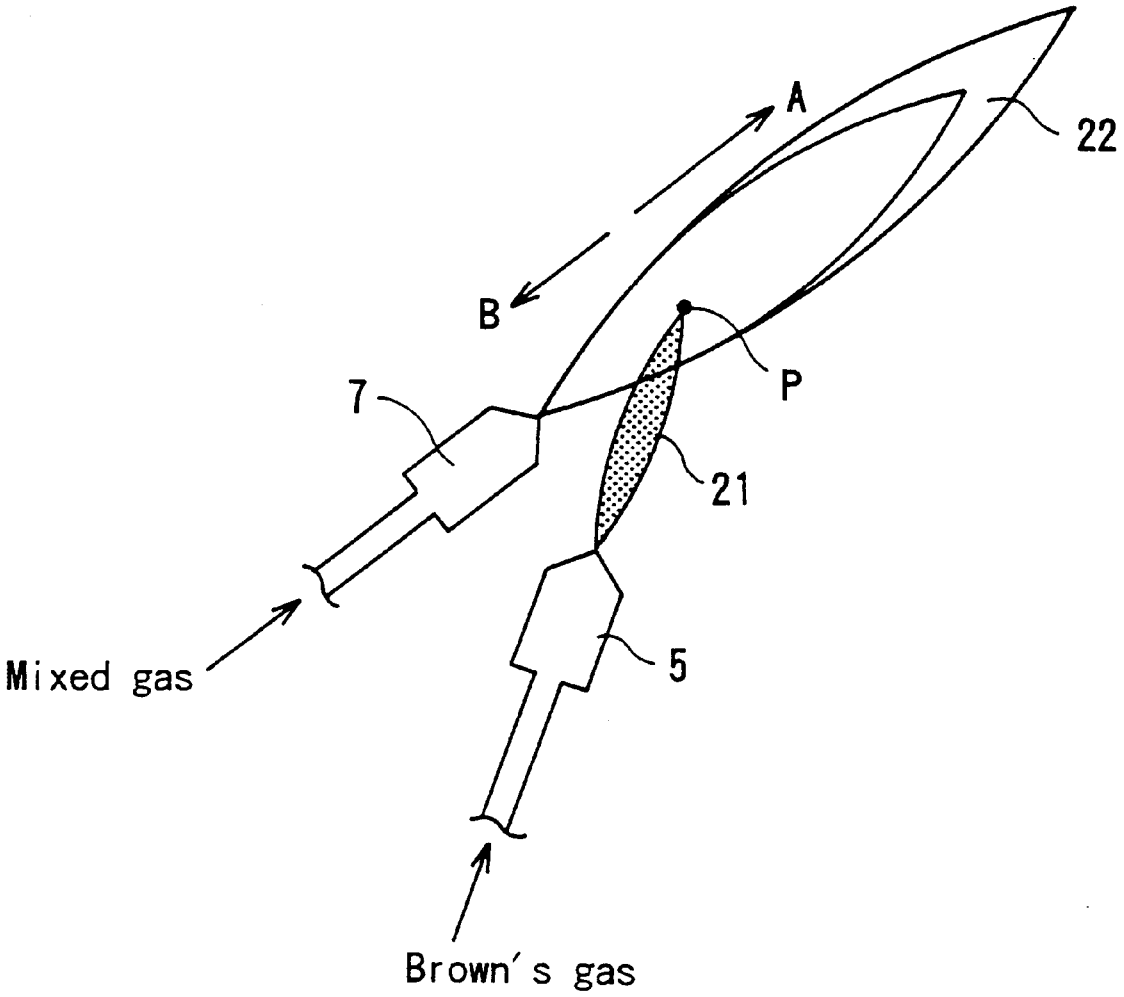
FIG. 2 is an illustrative view showing the mixed gas flow and the Brown's gas flame in the combustion apparatus of the present invention.

FIG. 2 shows an illustrative view, on a large scale, of the state of the flame from the Brown's gas combustion burner 5 and the gas flow from the mixed gas burner 7.

When the Brown's gas flame 21 (at about 2,300° C.) from the Brown's gas combustion burner 5, preferably the tip of the Brown's gas flame 21, is brought in contact with the point P of the mixed gas flow jetted from the mixed gas burner 7, the fossil fuel component in the mixed gas is combusted at a high temperature of over 4,000° C. due to the reaction with the Brown's gas flame. This high temperature causes the water vapor in the mixed gas to be decomposed into a gas mainly composed of a Brown's gas. This gas combusts by itself instantaneously at the point P, and this combustion leads to flame propagation, thereby causing chain combustion in the directions of A and B from the point P, and as a result the entire of the mixed gas jetted from the mixed gas burner 7 is combusted. In the figure, 22 indicates the flame of the combustion of the mixed gas.

At that time, preferably the mixed gas burner 7 and the Brown's gas combustion burner 5 are arranged in such a manner that the contact crossing angle between the mixed gas flow and the Brown's gas flame becomes 15 to 30°. In FIG. 1, although only one Brown's gas combustion burner 5 is shown, it is possible to provide, equi-spaced, two or more Brown's gas combustion burners, preferably two or three equi-spaced Brown's gas combustion burners, around the mixed gas burner 7, so that the above crossing angle may be secured respectively. The position of the point P where the Brown's gas flame comes in contact is generally in the range where the temperature of the mixed gas flow is not lowered but is retained suitably, and preferably the position of the point P is about 5 cm away from the nozzle tip of the mixed gas burner 7.

Figure 3:
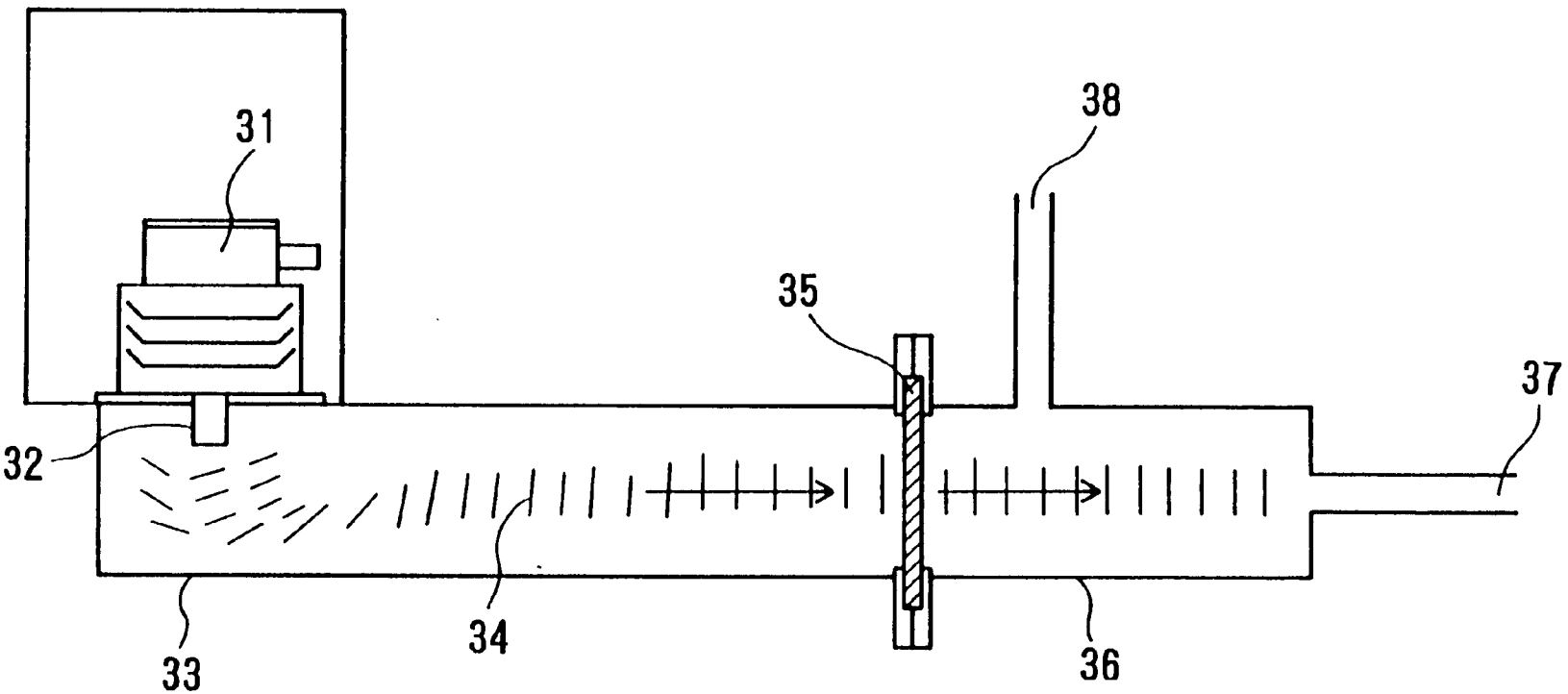
FIG. 3 is an illustrative view showing an example of a microwave-irradiating apparatus.

Further, FIG. 3 is a schematic illustrative view of one example of the microwave-irradiation apparatus 3 of the apparatus shown in FIG. 1. Microwaves 34, having a wavelength of 2,450 MHz, oscillated by a magnetron 31, are introduced from a window of a quartz glass 35, having a pressure-resistant structure, through an antenna 32 and a coupler 33 into a waveguide 36, where they heat the water/fossil fuel mixed emulsion introduced from an inlet 37, and then the water/fossil fuel mixed emulsion is passed from an outlet 38 into the vaporization chamber.

Figure 5:
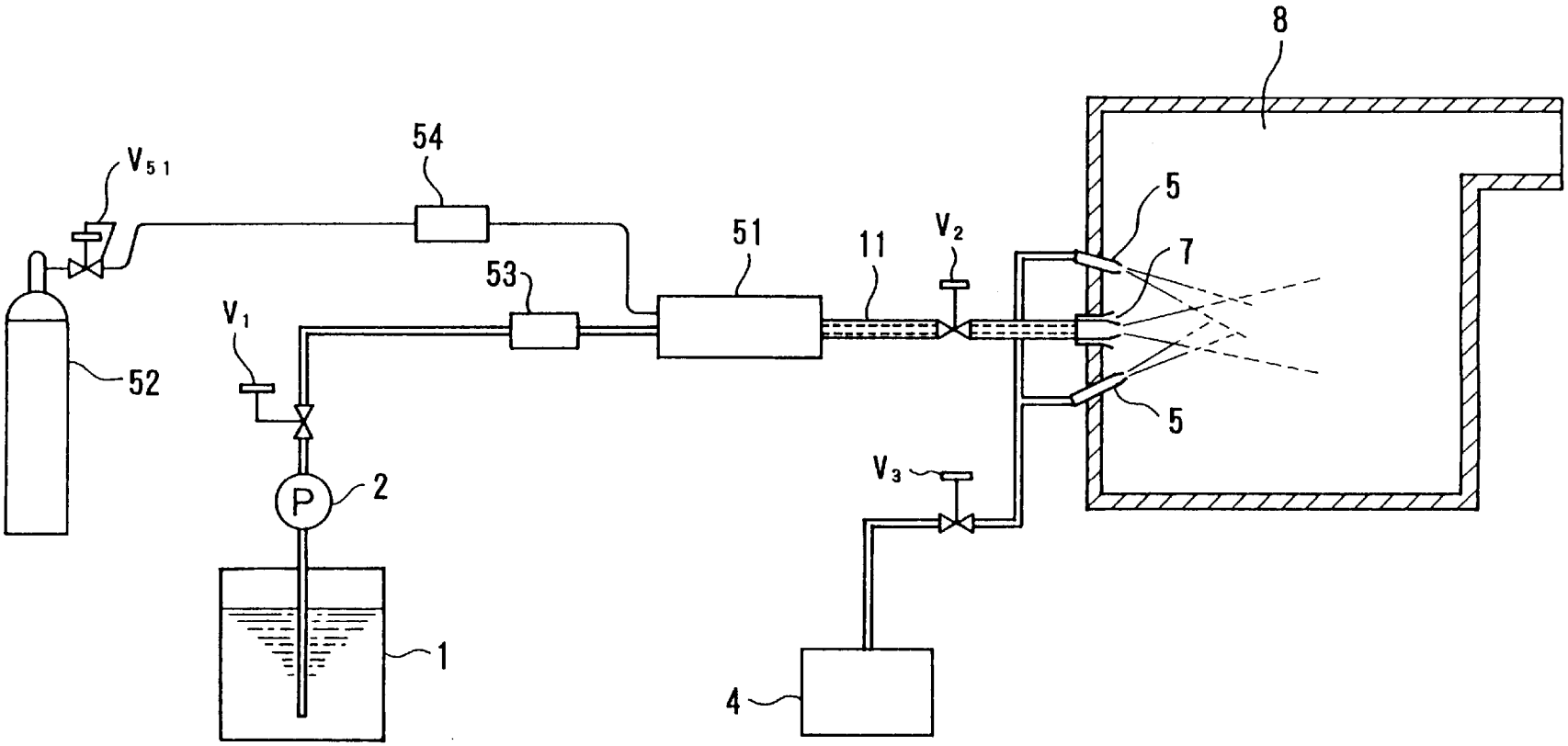
FIG. 5 is an illustrative view showing another constitution of the combustion apparatus of the present invention.

FIG. 5 is an illustrative view showing the constitution of another embodiment of the apparatus of the present invention; in this example a liquid vaporization supply system is used, in which a carrier gas is used to elevate the temperature and vaporize the water/fossil fuel mixed emulsion. In the figure, the same symbols as those in FIG. 1 indicate the same things; 51 indicates a fuel vaporizer, 52 indicates a carrier gas cylinder, 53 and 54 indicate mass flow controllers, respectively, for the emulsion and the carrier gas, and $V_{51}$ indicates a valve.

In this apparatus, the water/fossil fuel mixed emulsion is passed from the storage tank 1 by the supply pump 2 through the valve $V_1$, to be fed into the fuel vaporizer 51 through the mass flow controller 53, wherein it is adjusted to about 40 ml/min. The body of the vaporizer is heated to about 150° C. by a built-in electric heater (not shown). On the other hand, the carrier gas (for example, oxygen gas), whose flow rate has been adjusted by the valve $V_{51}$ and the mass flow controller 54, is introduced from the carrier gas cylinder 52 into the vaporizer 51. In this liquid vaporization supply system, the water/fossil fuel mixed emulsion is supplied to a pressure-reducing nozzle (not shown) of the vaporizer 51, while the carrier gas is supplied from periferal holes of the pressure-reducing nozzle. Due to this carrier gas, the rate of the water/fossil fuel mixed emulsion becomes about 100 m/sec, and it is moved through the vaporizer, wherein the pressure is reduced to about ordinary pressure, to cause it to vaporize.

The mixed gas, whose temperature has been brought to about 110° C. as a result of the vaporization due to the above reduction in pressure, is jetted through the valve $V_2$ from the mixed gas burner 7 of the combustion chamber 8. For transportation of this high-temperature gas, the piping is preferably covered with the heat-resistant covering material 11, like the constitution in FIG. 1.

On the other hand, the Brown's gas combustion burners 5 and 5, near the mixed gas burner 7, jet the Brown's gas produced in the Brown's gas generating apparatus 4 through the valve $V_3$, and it is ignited by igniters (not shown), to form Brown's gas flames in contact with the gas flow from the mixed gas burner 7, to combust the mixed gas flow.

Like the apparatus in FIG. 1, also in the apparatus of the present invention shown in FIG. 5, when the water/fossil fuel mixed emulsion is combusted, it is not required to elevate the temperature of the combustion chamber 8 as a whole, and the contact of the Brown's gas flames can cause the gas produced from the water/fossil fuel mixed emulsion to be combusted completely.

The combustion method and the combustion apparatus of the present invention can be employed in various systems that are operated using warm air, steam, or the like, and they can, for example, be used with a furnace, a boiler, a warm air generator, a gas turbine generator, or the like connected to the above combustion chamber.

According to the present invention, a water/fossil fuel mixed emulsion low in fossil fuel content can be combusted efficiently, to obtain high calories resulting from the combustion, with the produced amount of $CO_2$ reduced. In the present invention, by bringing a Brown's gas flame in contact with a flow of a mixed gas obtained by vaporizing a water/fossil fuel mixed emulsion, the entire of the mixed gas can be combusted at a high temperature economically with good energy efficiency, unlike the conventional technique, wherein the entire environment of the combustion is brought to a very high temperature.

The present invention will now be described in more detail with reference to the following example, but the invention is not limited to it.

EXAMPLE

Example 1

Figure 4:
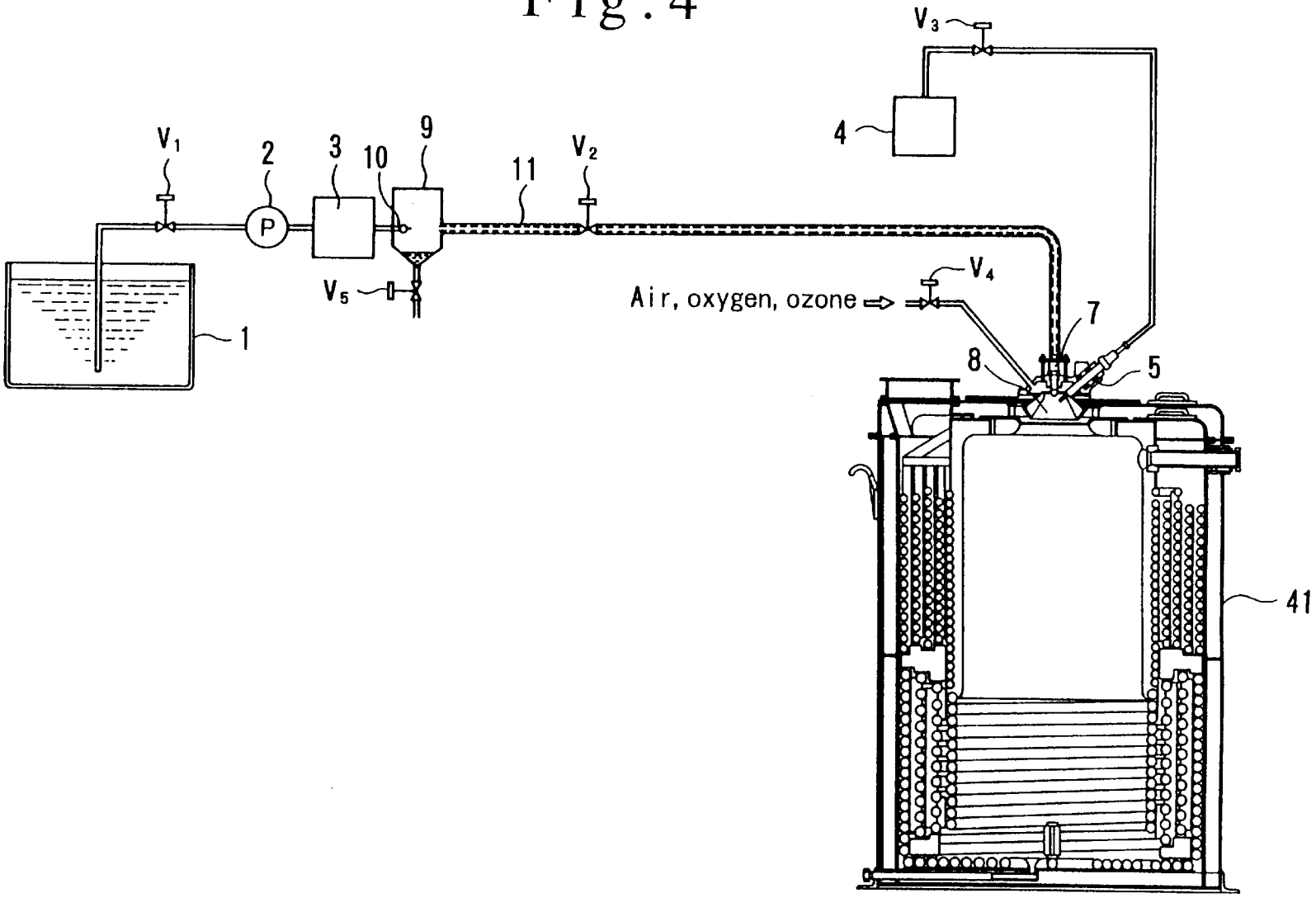
FIG. 4 is an illustrative view showing the constitution of an example of a boiler system in which the present invention is applied.

A boiler system having the constitution shown in FIG. 4 was run, and the quantity of the generated heat and the like was measured. In the figure, the same symbols as those in FIG. 1 indicate the same things, and 41 indicates a full automatic boiler (KSK-SG boiler, manufactured by Kawasaki Heavy Industries Ltd.). The water/fossil fuel mixed emulsion used was made up of distilled water and kerosene in a volume ratio of 90:10, to which tourmaline (having a particle diameter of 1.0 $\mu$m), in an amount of 3% by weight based on the water, was added.

The water/kerosene mixed emulsion was supplied under 4.5 MPa by a pump 2 at a rate of 34 liters/hour for 24 hours. The water/kerosene mixed emulsion of 20° C. was heated in a microwave-irradiation apparatus 3 to 249° C. in about 90 sec, by irradiation with microwaves of 2,450 MHz, and then it was vaporized in a vaporization chamber 9, by reducing the pressure to 0.05 MPa. The temperature of the mixed gas jetted from a burner 7 was 150° C.

A Brown's gas from a burner 5 was ignited with an igniter (not shown), and when the tip of the Brown's gas flame (5 cm away from the tip of the burner), at 2,300° C., was brought in contact with the mixed gas flow from the burner 7, the mixed gas combusted with a flame, which continued.

The quantity of the heat generated by the water/kerosene mixed emulsion in this boiler was measured by a steam-heat-measuring system, which automatically measures the quantity of generated heat from the quantity of heat of the water at the inlet and the quantity of heat of the steam at the outlet, and the quantity of heat was found to be about 6,000 kcal/kg.

The calculation of the ratio of the cost of the water/kerosene mixed emulsion (calories resulting from the combustion, about 6,000 kcal/kg; and the cost, 7 yen/kg) for the combustion calories generated in the above boiler system, which is the same as the combustion calories of kerosene, to the cost of kerosene (calories resulting from the combustion, about 10,300 kcal/kg; and the cost, 50 yen/kg) is:

$$(10{,}300/6{,}000)\times(7/50)\approx 0.24$$

and therefore the water/kerosene mixed emulsion used in Example 1 gives the same calories resulting from the combustion as that of kerosene, at a fuel cost of 24% of the kerosene.

The heat output of the steam generated per hour was 233 kW, while the external inputs were 12 kW for the microwave irradiation and 7 kW for generation of the Brown's gas; that is, the heat output was about 12 times the total input.

Comparative Example

Using the same boiler system as that in Example 1, the Brown's gas-generating apparatus was stopped, and when it was attempted to ignite the mixed gas prepared by elevating the temperature and vaporizing the same water/kerosene mixed emulsion as that used in Example 1, with a propane gas flame, the mixed gas did not combust at all.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method of combusting a water/fossil fuel mixed emulsion, comprising elevating the temperature of a water/fossil fuel mixed emulsion, vaporizing the water/fossil fuel mixed emulsion, and bringing a Brown's gas flame that results from the combustion of a Brown's gas, in contact with the flow of the water/fossil fuel mixed gas thus formed by that elevation of the temperature and that vaporization, thereby combusting the water/fossil fuel mixed gas.

2. The method of combusting a water/fossil fuel mixed emulsion as claimed in claim 1, wherein the proportion of the fossil fuel in the water/fossil fuel mixed emulsion is 10 to 30% by volume.

3. The method of combusting a water/fossil fuel mixed emulsion as claimed in claim 1, wherein the water/fossil fuel mixed emulsion is irradiated with microwaves, to elevate the temperature of the emulsion, thereby vaporizing the emulsion.

4. The method of combusting a water/fossil fuel mixed emulsion as claimed in claim 1, wherein the water/fossil fuel mixed emulsion is heated, and a carrier gas for carrying the emulsion is introduced, to elevate the temperature of the emulsion, thereby vaporizing the emulsion.

5. The method of combusting a water/fossil fuel mixed emulsion as claimed in claim 1, wherein the water/fossil fuel mixed emulsion contains an electric stone.

6. The method of combusting a water/fossil fuel mixed emulsion as claimed in claim 5, wherein the electric stone is tourmaline.

7. An apparatus for combusting a water/fossil fuel mixed emulsion, comprising an apparatus for elevating the temperature of a water/fossil fuel mixed emulsion and vaporizing the water/fossil fuel mixed emulsion; a mixed gas burner for jetting the water/fossil fuel mixed gas that results from that elevation of the temperature and that vaporization; a Brown's gas combustion burner; and a combustion chamber provided with the mixed gas burner and the Brown's gas combustion burner; wherein, in the combustion chamber, the Brown's gas flame of the Brown's gas combustion burner can be in contact with the flow of the gas jetted from the mixed gas burner.

8. The apparatus for combusting a water/fossil fuel mixed emulsion as claimed in claim 7, wherein the apparatus for elevating the temperature of the water/fossil fuel mixed emulsion and vaporizing the water/fossil fuel mixed emulsion is an apparatus that comprises a microwave irradiation apparatus for elevating the temperature of the emulsion by irradiating the emulsion with microwaves, and a vaporization chamber for vaporizing the emulsion by reducing the pressure on the emulsion, with the microwave irradiation apparatus and the vaporization chamber being joined.

9. The apparatus for combusting a water/fossil fuel mixed emulsion as claimed in claim 7, wherein the apparatus for elevating the temperature of the water/fossil fuel mixed emulsion and vaporizing the water/fossil fuel mixed emulsion is an apparatus that comprises a vaporizer for introducing a carrier gas together with the emulsion, and a heater.

10. The apparatus for combusting a water/fossil fuel mixed emulsion as claimed in claim 7, wherein the combustion chamber is provided with two or more Brown's gas combustion burners.

11. The apparatus for combusting a water/fossil fuel mixed emulsion as claimed in claim 10, wherein the combustion chamber is provided with two or three Brown's gas combustion burners.

* * * * *